US007997243B2

(12) United States Patent
Florek

(10) Patent No.: US 7,997,243 B2
(45) Date of Patent: Aug. 16, 2011

(54) BALL TYPE VALVE ROTATOR

(76) Inventor: Bronislaw B. Florek, Dousman, WI (US)

( * ) Notice: Subject to any disclaimer, the term of this patent is extended or adjusted under 35 U.S.C. 154(b) by 222 days.

(21) Appl. No.: 12/429,227

(22) Filed: Apr. 24, 2009

(65) Prior Publication Data

US 2009/0272344 A1 Nov. 5, 2009

Related U.S. Application Data

(60) Provisional application No. 61/125,863, filed on Apr. 30, 2008.

(51) Int. Cl.
*F01L 1/32* (2006.01)

(52) U.S. Cl. ..... 123/90.3; 123/90.28; 123/188.1; 123/190.1; 137/331

(58) Field of Classification Search ..... 123/90.28, 123/90.29, 90.3, 188.1, 190.1; 137/330, 137/331

See application file for complete search history.

(56) References Cited

U.S. PATENT DOCUMENTS

| | | | | |
|---|---|---|---|---|
| 2,855,913 | A | 10/1958 | Geer | |
| 3,890,943 | A | 6/1975 | Schonlau et al. | |
| 3,892,210 | A | 7/1975 | Kuhn et al. | |
| 4,075,987 | A | 2/1978 | Tauschek et al. | |
| 4,094,280 | A | 6/1978 | Updike | |
| 4,141,325 | A | 2/1979 | Shalaty | |
| 4,154,424 | A | 5/1979 | Cherrie | |
| 4,227,493 | A | 10/1980 | Updike | |
| 4,425,882 | A | 1/1984 | Updike et al. | |
| 4,538,558 | A | 9/1985 | Updike et al. | |
| 4,597,408 | A | 7/1986 | Canter | |
| 5,727,507 | A | 3/1998 | Johansson | |
| 6,588,391 | B2 * | 7/2003 | Gebauer et al. | 123/188.9 |
| 6,662,770 | B2 | 12/2003 | Engesser | |

FOREIGN PATENT DOCUMENTS

| | | |
|---|---|---|
| JP | 11-324619 | 11/1999 |

OTHER PUBLICATIONS

International Search Report for International application No. PCT/US2009/041600, International filed is Apr. 24, 2009.

* cited by examiner

*Primary Examiner* — Ching Chang
(74) *Attorney, Agent, or Firm* — Boyle Fredrickson, S.C.

(57) ABSTRACT

An improved ball type valve rotator is provided that includes a main body segment having a bottom wall with an upper surface, and a body cap that overlies the main body segment. A ball cages assembly is housed between the main body segment and the body cap. The ball cages assembly includes multiple ramps with lower surfaces that are spaced from the bottom wall upper surface of the main body segment. This allows the multiple ramps to deflect toward the bottom wall upper surface of the main body segment. The multiple ramps can deflect independently of each other, so that different distances can be defined between the different ramps and the bottom wall upper surface of the main body segment. In so doing, the ball cage assembly can accommodate non-uniform applications of force into the valve rotator.

20 Claims, 9 Drawing Sheets

BALL TYPE VALVE ROTATOR

CROSS REFERENCE TO RELATED APPLICATIONS

This application claims priority under 35 U.S.C. §119(e) to U.S. Provisional Patent Application Ser. No. 61/125,863, filed on Apr. 30, 2008, the entirety of which is expressly incorporated by reference herein for all purposes.

BACKGROUND OF THE INVENTION

1. Field of the Invention

This invention relates to internal combustion engine valvetrain components and, more particularly, to valve rotators.

2. Discussion of the Related Art

Valve rotators are commonly used in some internal combustion engines to provide positive valve rotation during each cycle of an opening phase of engine valve actuation. It is known and appreciated that even slight rotation of a valve during use can increase engine service intervals and extend valvetrain use life by, e.g., minimizing burning and guttering type wear of valves, reducing thermal differentials across each individual valve, reducing carbon buildup on the valves, promoting valve stem lubrication, and/or other benefits.

Known valve rotators are typically classified as being either garter type valve rotators or bearing ball rotators which are commonly referred to as ball type valve rotators. Both garter and ball type valve rotators can be installed in place of a valve spring retainer on the top of a valve spring, or as an additional valvetrain component installed under a valve spring. In either case, whether used as a supplemental valvetrain component, or a replacement component, the valve rotators function by, e.g., utilizing energy associated with valve spring compressive forces and converting such energy into rotational movement of a rotator body within a rotator housing and correspondingly rotating the valve itself.

Garter type valve rotators can be configured as relatively lightweight and relatively inexpensive components. Garter type valve rotators include a garter spring defined by a helically wound spring member that is bent into an annular arrangement, giving it a circular perimeter shape. In this configuration, as the valve spring is compressed and loaded, a spring disk within the garter type valve rotator deflects. The spring disk deflection is transmitted through the garter spring, folding its coils down and forward, correspondingly shifting or rotating the rotator body and thus also the valve attached to it. When the valve spring unloads, the garter spring also unloads, restoring it to its default configuration. This cycle of garter spring loading and unloading, and pushing the valve into rotation, is repeated during subsequent valve actuation (s). In other words, this completes a cycle of valve rotation that is repeated with every opening and closing of the valve.

However, due to size constraints, garter springs of garter type valve rotators are made from relatively small diameter spring material. Correspondingly, the garter springs can have a relatively short use life due to, e.g., exposure to various fatigue forces, loading and unloading at a high rate of recurrence or frequency, temperature cycling between periods of use and non-use, and/or other factors or stresses endured during use.

In light of the above mentioned durability and reliability concerns associated with the garter springs of garter rotators, ball rotators are often preferred for certain implementations, such as for use in relatively larger engines. Ball rotators typically include a circularly shaped housing with multiple sloped pockets formed thereinto. Bearing balls, along with helical compression springs that bias them, are provided in the sloped pockets of the housing in a manner that biases the bearing balls toward shallow ends of the sloped pockets. The bearing balls and springs are further confined by a spring disk resting on a stepped flange of the rotator body, such that the spring disk and pockets, in combination, totally encapsulate the bearing balls and springs. During use, as the valve spring is compressed and loaded, the spring disk deflects, transferring force from the valve spring into bearing balls of the rotator. Since the balls rest on the top of sloped surfaces of the pockets embedded in the flange of the rotator body, rolling motion of the bearing balls occurs which rotates the rotator body and thus also the valve attached to it.

For example, U.S. Pat. No. 2,397,502 discloses a known ball type valve rotator. The ball type rotator is placed on the top of the valve spring, replacing the valve spring holder, and includes a rotator body and housing, multiple bearing balls and cooperating helical springs, a spring disk. The rotator body has a tapered central section, an annular outer flange segment, and a stepped flange as a medial segment transitioning therebetween. The tapered central section connects to the valve, the stepped medial segment serves as a resting place for the spring disk, and the outer flange segment has multiple pockets formed thereinto. The pockets confine bearing balls and helical springs therein, and the bottom walls of the pockets are sloped. The bearing balls and springs are arranged so that the bearing balls bias toward shallow ends of the pockets. A circularly shaped housing encapsulates the bearing balls, springs, and spring disk, and it has a flange that serves as a seat for the valve spring. In this configuration, an inner edge of the spring disk rests on the stepped medial segment of the rotator body, whereas an outside edge of the spring disk rests on a bottom surface of the housing flange, whereby the spring disk carries the load of the compressed valve spring. Accordingly, the spring disk deflects proportionally to the magnitude of the valve spring force.

In other words, during engine operation, as the valve opens, the valve spring is being increasingly compressed, increasing the force applied to the spring disk which further deflects the spring disk and correspondingly decreases an effective height of the pockets containing the bearing balls. At this point, the spring disk rests mostly on the bearing balls, whereby the inner portion of the spring disk lifts away from and is no longer supported by the stepped medial segment of the rotator body. This transmits forces of the valve spring into the bearing balls that are confined in the pockets. Since the rotator body is no longer held by frictional forces defined between the stepped medial segment of the rotator body and the spring disk, the bearing balls are free to roll down into the deeper ends of the pockets, forcing the rotator body to shift circularly.

Namely, since the rotator housing and the spring disk stay attached to the valve spring, the rolling motion of the bearing balls is translated into a rotation of the rotator body and the valve attached to it. As the valve closes, the valve spring decompresses which lessens the force on the spring disk, making it return to its previous shape. Such relaxation of the spring disk increases the effective height of the pockets. As the effective height of each pocket increases, the bearing balls are pushed by the helical springs, back into the shallow ends of the pockets. This completes a cycle of valve rotation that is repeated with every opening and closing of the valve.

As with typical ball type valve rotators, those disclosed in U.S. Pat. No. 2,397,502 include a cast, machined, and hardened steel rotator body. This component is labor or process intensive to make, and is correspondingly relatively expensive. Furthermore, installing the multiple bearing balls, multiple springs, spring disk, and housing requires crimping a top rim of the housing over a top edge of the rotator body, and/or retaining the rotator housing and body with a wire retainer inserted in a grove within the rotator body. This is a labor or process intensive operation that yet further increases the end price of the total assemblage.

U.S. Pat. No. 6,588,391 discloses another known ball type rotator that functions similar to that seen in U.S. Pat. No. 2,397,502, but includes a rotator body that is made by joining two components instead of a single cast and machined component. A first component that is used to make the rotator body is stamped from sheet metal, has a deep drawn conical inner segment, and pockets are drawn from material at an outer flange portion. While forming such first components, during the drawing or pressing procedure, one end of the pocket is formed by shearing which leaves a gap or opening at the respective end. The second component that is used to make the rotator body is a holding ring that is used to retain and guide the bearing balls and their actuating springs, since the pockets formed into the first component are not sufficiently deep to house them. The first and second components are hardened and joined to each other by hump or bulge welding, forming a single unitary rotator body.

These components can be difficult to manufacture and assemble. Deep drawing the conical inner segment can be difficult to accomplish while maintaining suitably consistent material thickness required for structural integrity. It is noted that like other valvetrain components, valve rotators must meet stringent dimensional and structural requirements since they are subjected to high local stresses and fatigue forces of repeatedly valve opening and closing cycles. In addition, although the openings at the pocket ends can intake lubrication, they can also intake non-desired debris or other materials or substances. The corners or ends of the shear line, from which the pocket end openings are defined, can further tear, potentially compromising the structural integrity of the rotator body. It is further noted that the hardening and hump or bulge welding can be labor or procedurally intensive, increasing the end price of the valve rotator.

In typical prior art ball type valve rotators, the pockets that hold the bearing balls and springs have bottom walls that are rigid or inflexible, regardless of whether the pockets are formed by machining a casting, formed by drawing sheet material in a punch-pressing or other operation, or other configurations. It is further noted that in the dynamically changing high stress and load environment in which valve rotators operate, the forces that are applied to the valve rotators are rarely evenly distributed about the rotator body and/or housing. In other words, during use, valve rotator bodies and/or housings are subjected to highly localized applications of the input forces. The bearing ball(s) nearest such localized application of force therefore bears relatively more stress of the input force and carry more or even a majority of the load, as compared to the other bearing balls. This can create point loading between such bearing balls and the spring disk with sufficiently great force to create pitting in, or wear grooves into, the spring disk which can shortening its use life.

SUMMARY OF THE INVENTION

It could prove desirable to provide a valve rotator that overcomes the abovementioned drawbacks of the prior art. For example, it could prove desirable to provide a ball type valve rotator that is relatively inexpensive and/or simple to produce. It could prove desirable to provide a ball type valve rotator that reduces occurrences of spring disk pitting or grooving when the ball type valve rotator is subjected to input forces that are non-uniformly applied across surfaces of the valve rotator. It could further prove desirable to provide a ball type valve rotator that can accommodate non-uniformly applied forces by balancing a distribution of them between the multiple bearing balls.

In accordance with a first aspect of the present invention, an improved ball type valve rotator is provided that includes a main body segment having a bottom wall with an upper surface, and a body cap that overlies the main body segment. A ball cages assembly is housed between the main body segment and the body cap. The ball cages assembly includes multiple ramps with lower surfaces that are spaced from the bottom wall upper surface of the main body segment. This allows the multiple ramps to deflect toward the bottom wall upper surface of the main body segment. The multiple ramps can deflect independently of each other, so that different distances can be defined between the different ramps and the bottom wall upper surface of the main body segment. In so doing, the ball cage assembly can accommodate non-uniform applications of force into the valve rotator.

In some embodiments, the ramps can be deflected independently of each other, such that non-uniform forces that are axially directed into the housing assembly deflect differing ramps to differing extents, respectively, balancing a distribution of the non-uniform forces between the multiple bearing balls.

The ball cage assembly can include a flange and the ramps can extend upwardly from the flange. The flange can be annular and the ramps can be provided outside or inside of the flange. For example, the ramps are provided outside of an outer perimeter of the flange, or inside of an inner perimeter of the flange. In some implementations, projections are provided which extend between and connect the ramps to the outer perimeter of the flange. In other embodiments, the projections extend between and connect the ramps to the inner perimeter of the flange.

In some embodiments, the ball cage assembly includes front walls extending upwardly from the ramps. For embodiments of the ball cage assembly that are stamped out of a single piece of material, and/or others, a distance between a leading edge of a first projection and a trailing edge of a second adjacent projection corresponds to a summation of (i) a length of a ramp extending between the first and second projections, and (ii) a height of a front wall extending from the ramp.

In some implementations, the valve rotator can also have side walls that extend upwardly from the projections that connect the ramps to the flange. The side walls can be arranged generally perpendicularly to the ramps, and/or otherwise.

In some implementations, each of the ramps includes an apex that connects first and second sloping segments of the ramp which slope in opposing directions.

In another family of embodiments, the multiple ramps can deflect during instances of axial compressive loading of the valve rotator in a manner that ensures that the ramps maintain angles of inclination, while deflecting, such that the bearing balls roll down the respective ramps during such instances of axial compressive loading of the valve rotator. Stated another way, the ramps are configured to accommodate non-uniform axial force applications to the valve rotator, which squeezes the main body segment and body cap together and lessens the space therebetween, by selectively deflecting. The ramps can deflect independently of each other, whereby non-uniform forces that are axially directed into the housing assembly deflect differing ramps to differing extents. Doing so facilitates balancing a distribution of the non-uniform forces between the multiple bearing balls, mitigating instances of overloading one or less than all of the bearing balls.

Various alternative embodiments and modifications to the invention will be made apparent to one of ordinary skill in the art by the following detailed description taken together with the drawings.

BRIEF DESCRIPTION OF THE DRAWINGS

The drawings illustrate a preferred and exemplary embodiment of the invention.

In the drawings.

DETAILED DESCRIPTION OF THE PREFERRED EMBODIMENTS

Figure 1:
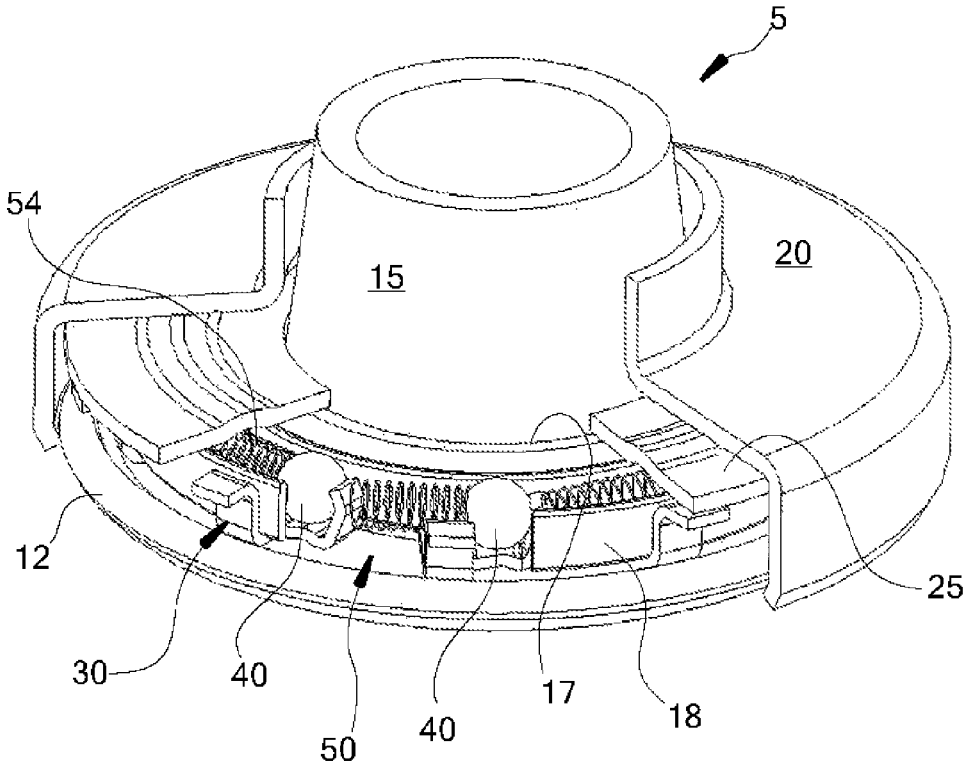
FIG. 1 is a pictorial view of an embodiment of a valve rotator with a portion of a body cap and a portion of a spring disk being cut away.

The present invention and the various features and advantageous details thereof are explained more fully with reference to the non-limiting embodiments described in detail in the following description.

Turning now to the drawings, FIGS. 1-5 show various implementations of ball type valve rotators, e.g., valve rotators 5, which are incorporated into valvetrains of internal combustion engines. Valve rotators 5 are attached to valves, e.g., upon valve stems, and can be installed in any of a variety of places and manners upon the valves. For example, valve rotators 5 can be installed in place of or in addition to a valve spring retainer on the top of a valve spring. In other implementations, the valve rotators can be installed under the valve spring. Regardless of whether it is implemented as a supplemental or replacement component in the valvetrain, the valve rotator 5 is configured to, e.g., utilize energy associated with valve spring compressive forces and convert such energy into rotational movement(s) of the valve itself. Stated another way, during use, a valve reciprocates the valve rotator 5 incrementally rotationally advances or re-indexes the valve within its seat so that the valve and/or valve seat wear in a relatively more uniform fashion.

Still referring to FIGS. 1-5, each valve rotator 5 includes a housing assembly 7, spring disk 25, and a ball cage assembly 30 therein. The housing assembly 7 includes a main body segment 10 and a body cap 20 overlying it, with the main body segment 10 and body cap 20 being configured to axially and rotationally move with respect to each other. The main body segment 10 and body cap 20 are preferably made of steel, e.g., stamped steel, while the spring disk 25 is preferably made of a spring steel material that is heat treated to provide the desired toughness and/or other properties and characteristics.

Spring disk 25 and ball cage assembly 30 and its various components such as, e.g., multiple bearing balls 40 that are held in multiple ball cages 50, are housed in a void space between the main body segment 10 and body cap 20. When in a resting or unloaded state, spring disk 25 sits upon the ball cage assembly 30, parallel to the bottom wall 12 of the main body segment 10, and extends radially between corresponding portions of the main body segment 10 and body cap 20. The main body segment 10 and body cap 20 cooperate with the spring disk 25 and ball cage assembly 30 to utilize energy associated with valve spring compressive forces, converting such energy into rotational movement of the valve.

Referring yet further to FIGS. 1-5, main body segment 10 includes a bottom wall 12 that can be substantially planar, annular in shape, and have an upper surface 14. An inner portion 15 of the main body segment 10 extends upwardly, for example, in a columnar or tapering frusto-conical manner. A throughbore extends axially through the inner portion 15 and accepts the valve therethrough. In this configuration, the inner circumferential surface of the inner portion 15, defined by the throughbore, can friction fit or otherwise grip against an outer circumferential surface of, e.g., the valve stem, locking them into rotational unison with each other.

Figure 2:
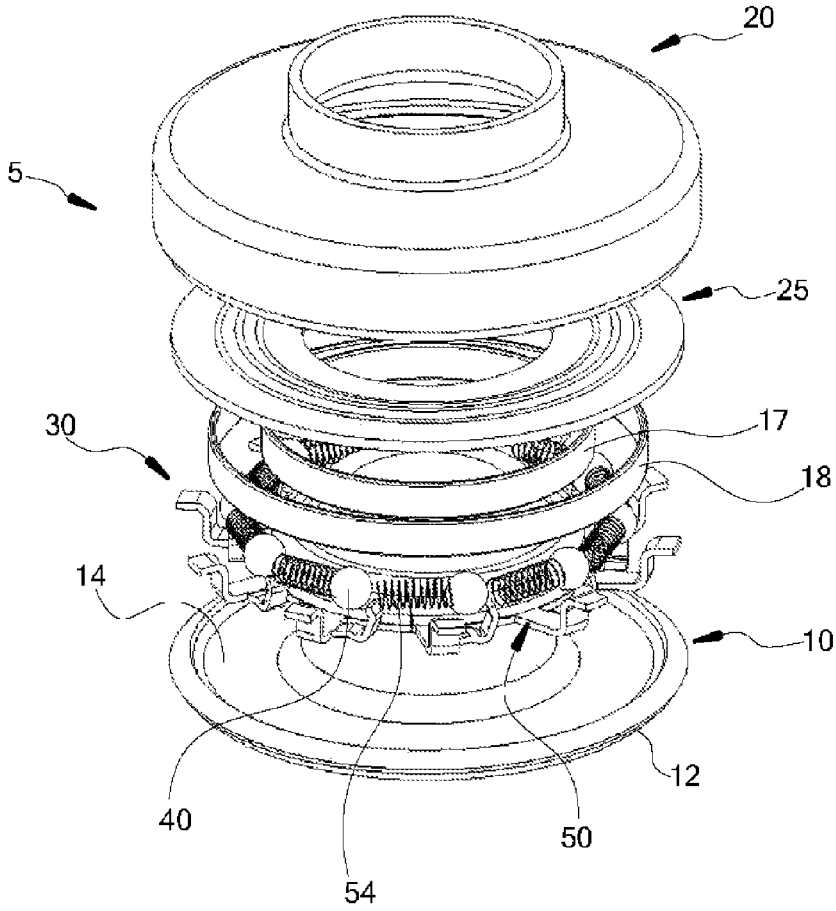
FIG. 2 is an exploded pictorial view of the valve rotator of FIG. 1.
Figure 3:
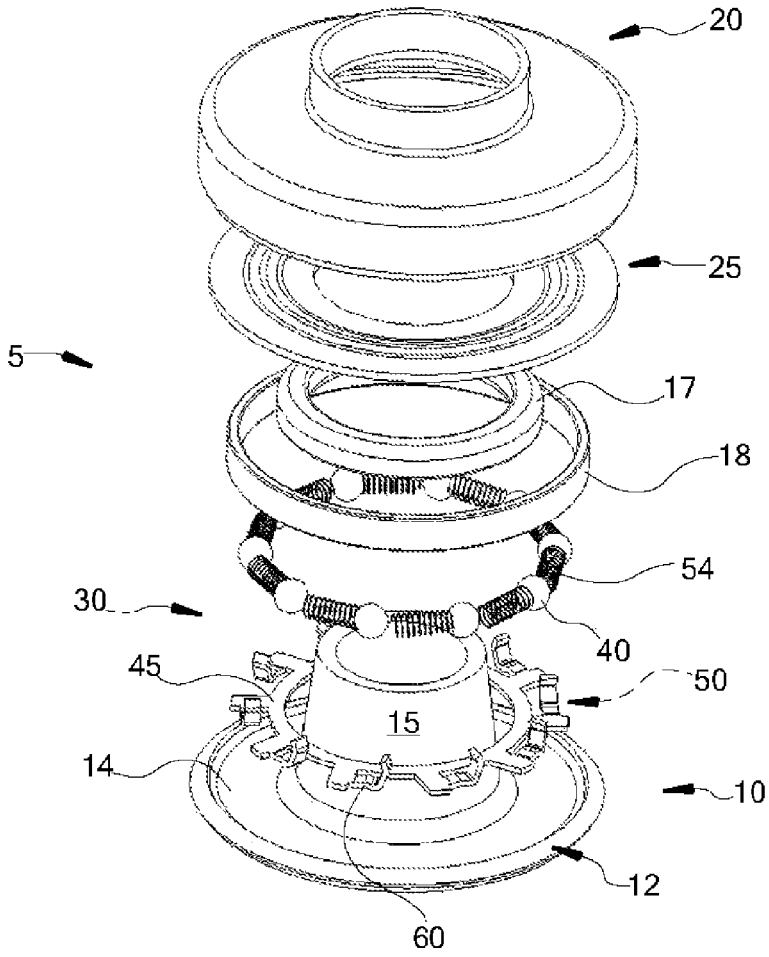
FIG. 3 is an exploded pictorial view of a variant of the valve rotator of FIG. 1.

Referring now to FIGS. 1-3, in some implementations, the upper surface 14 of bottom wall 12 can support inner spacer 17 and/or an outer spacer 18 structures that can be separate and distinct from other structures of the housing assembly 7. In such implementations, inner spacers 17 are arranged near or adjacent inner portions 15 of main body segment 10. Outer spacer 18 can be radially spaced from and concentrically surrounds outer spacer 18, defining an annular space therebetween. Inner spacer 17 and/or outer spacer 18 can at least partially (i) fill gaps within the housing assembly 7, (ii) locate ball cage assembly 30 within the housing assembly 7, and (iii) provide guidance or supplemental guidance to at least some of the components of the ball cage assembly 30. The inner and outer spacers 17 and 18 are typically not exposed to any significant forces, whereby they can be made of relatively inexpensive steel or other metal or plastic materials.

Figure 4:
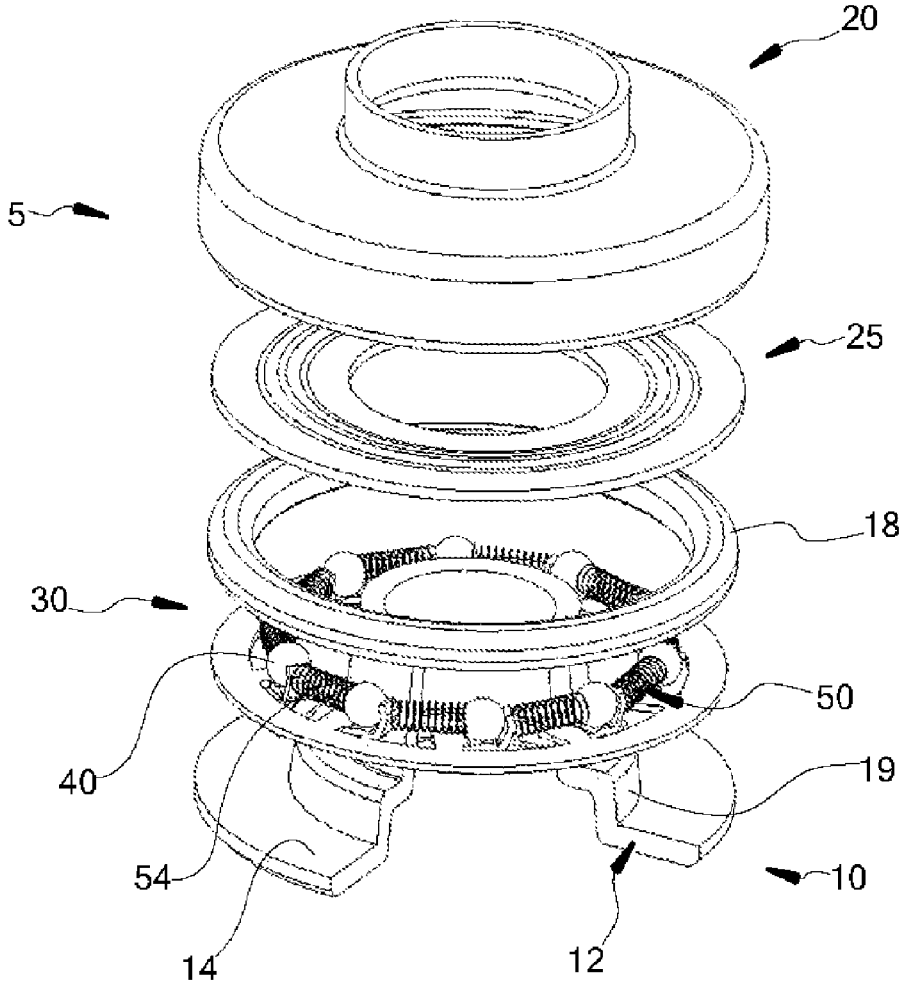
FIG. 4 is an exploded pictorial view of another variant of the valve rotator of FIG. 1.
Figure 5:
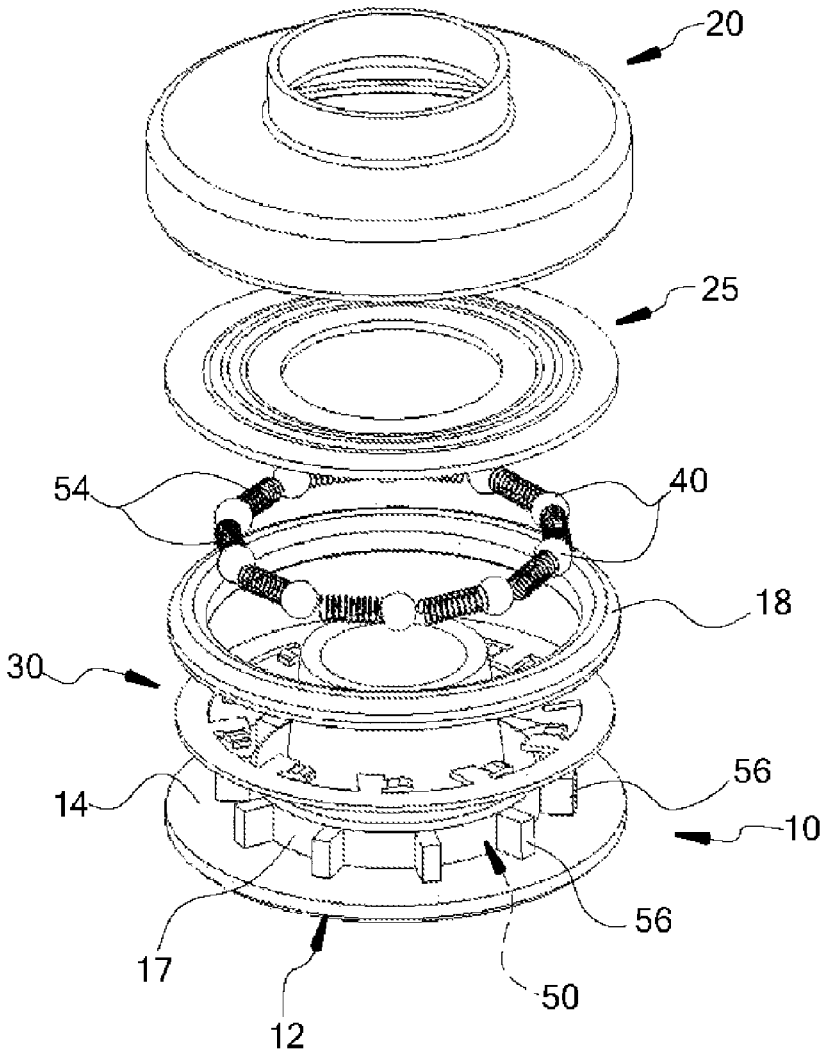
FIG. 5 is an exploded pictorial view of yet another variant of the valve rotator of FIG. 1.

Referring now to FIGS. 4 and 5, it is noted that one or both of inner and outer spacers 17 and 18 can be integrated into other components of the housing assembly 7, or other components of the valve rotator 5. In other words, whether inner and outer spacers 17 and 18, implemented as separate and distinct components, can influence the end configurations of various other components of the valve rotator 5. For example, as seen in FIGS. 4 and 5, the valve rotator 5 can be devoid of an inner spacer 17, and preferably in such implementations, inner portion 15 of main body segment 10 includes a stepped segment or shoulder 19. Shoulder 19 can perform at least some of the locating, guiding, and/or load-bearing function that would be otherwise performed by the inner spacer 17. Regardless of whether the inner and outer spacers 17 and 18 are incorporated as separate and distinct, or optionally as integral components, they can cooperate with the main body segment 10, body cap 20, spring disk 25, and ball cage assembly 30, to facilitate converting energy from the valve springs into rotation of the valves.

Referring again to FIGS. 1-5, body cap 20 overlies and cooperates with the main body segment 10 to generally define the enclosure of the housing assembly 7. Body cap 20 can have a wall that is generally circular and has a bore through which the inner portion 15 of the main body segment 10 can extend. A lip can extend downwardly from the circular perimeter of the body cap 20 wall and can be crimped over a corresponding portion of the main body segment 10, holding them together. This can alternatively be done using a retaining wire ring in a corresponding retainer groove, in a known manner.

Still referring to FIGS. 1-5, spring disk 25 is preferably one of a known configuration, being a planar and annular shaped member. Spring disk 25 extends between the main body segment 10 and the body cap 20, and is configured to deflect as main body segment 10 axially advances through the body cap 20. In other words, when the main body segment 10 and body cap 20 are squeezed together, the spring disk 25 distorts or bends. For example, best seen in FIG. 1, an edge defined at an intersection of the spring disk 25 lower surface and inner perimeter is supported by the main body segment 10 either directly by a portion of the main body segment 10 or indirectly by way of inner spacer 17, a portion of the ball cage assembly 30, or other suitable structure. An edge that is diagonally opposed to that just discussed on spring disk 25 can be defined at an intersection of the spring disk 25 upper surface and its outer perimeter, e.g., tucked into the transition between the circular wall of the body cap 20 and the lip extending therefrom.

Referring yet further to FIGS. 1-5, when the main body segment 10 and body cap 20 are squeezed together, the spring disk 25 is correspondingly pushed against the ball cage assembly 30. Upon so doing, the main body segment 10, body cap 20, spring disk 25, and ball cage assembly 30 cooperate to convert axially directed forces or force components, which squeeze the main body segment 10 and body cap 20 together, into rotational movement of the main body segment 10. This is accomplished by, e.g., forcing bearing balls 40 of the ball cage assembly 30 to roll in a manner that pulls or rotates the main body segment 10 by a corresponding amount, similar to the actuation of known ball type rotators, but unlike known ball type rotators, simultaneously accommodating and/or compensating for localized or other applications of force that are unacceptably large and which could lead to pitting, grooving, and/or other damage of the spring disk 25.

Referring still to FIGS. 1-5, the bearing balls 40 can be any of a variety of suitable known bearings. The particular number of bearing balls 40 that are implemented depend on, e.g., desired load-bearing capacity of the valve rotator 5, overall size of a particular valve rotator 5, and/or other end use considerations. However, it is noted that the various other components of ball cage assembly 30 occupy relatively little space within the valve rotator 5, allowing a relatively great number of bearing balls 40 to be incorporated into the valve rotator 5 per given cross-sectional area of the rotator 5, resulting in high load-bearing capacities. In other words, ball cage assembly 30 is configured to allow for, e.g., a maximum number of bearing balls 40 to be employed within a given size of the valve rotator 5, maximizing its load carrying capability.

Still referring to FIGS. 1-5, a base flange 45 can define primary structural component of the ball cage assembly 30 which supports, directly or indirectly, the multiple ball cages 50. Base flanges 45 can be generally planar and annular in configuration, and can serve as mounting substrates to which the multiple ball cages 50 are mounted.

Figure 6:
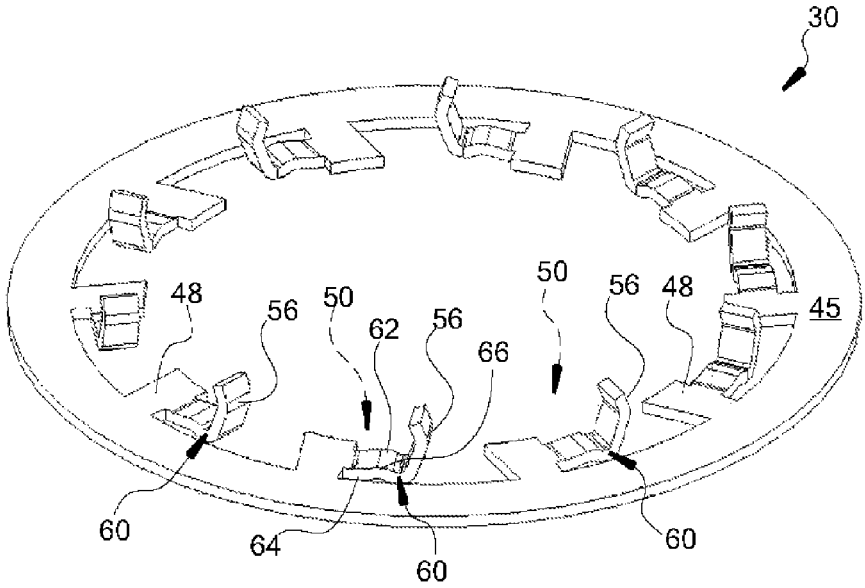
FIG. 6 is a pictorial view of a portion of the ball cage assembly of FIG. 4.

Referring now to FIGS. 6-9, base flange 45 and the ball cages 50 can be arranged in any of a variety of configurations with respect to each other, depending on the desired end use configuration of the valve rotator 5. For example, FIGS. 5-6 show implementations of base flanges 45 that are positioned peripherally outside of the ball cages 50, whereby the ball cages 50 extend radially inwardly from the base flanges 45. In yet other embodiments, such as those seen in FIGS. 7-9, base flanges 45 are positioned inside or inwardly of the ball cages 50, whereby the ball cages 50 extend radially outwardly from the base flanges 45.

Still referring to FIGS. 6-9, each ball cage 50 can include, e.g., a sidewall 52, a resilient member such as a spring 54 or other suitable resilient member, a front wall 56, and a ramp 60. Together, the sidewall 52, front wall 56, and ramp 60, along with the body cap 20, generally define an enclosure that holds a bearing ball 40, for example, resiliently holding the bearing ball 40 therein by way of spring 54.

Figure 7:
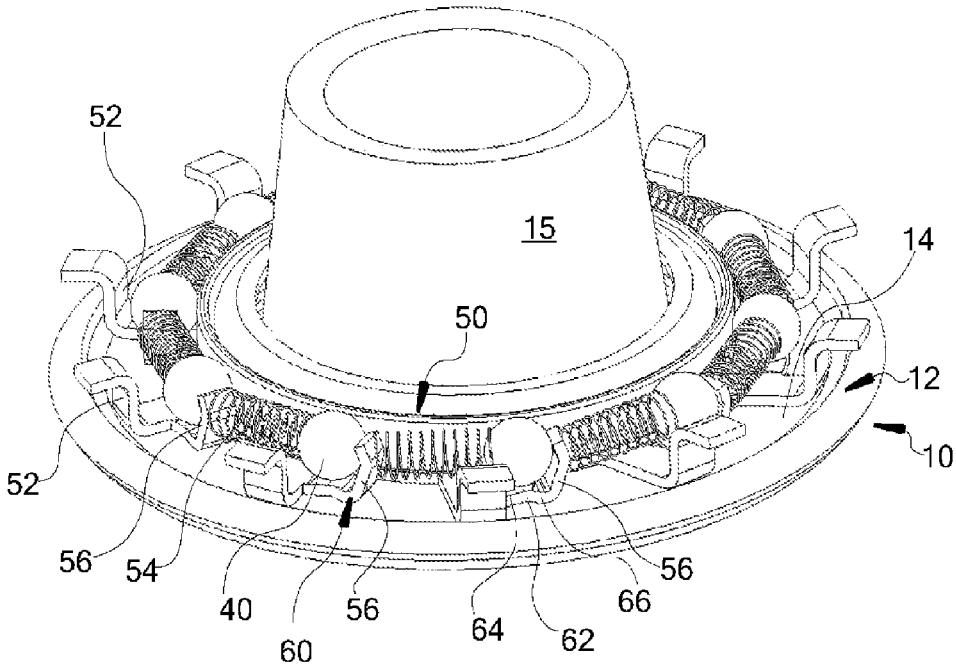
FIG. 7 is a pictorial of a partial assembly of the valve rotator of FIG. 2.
Figure 8:
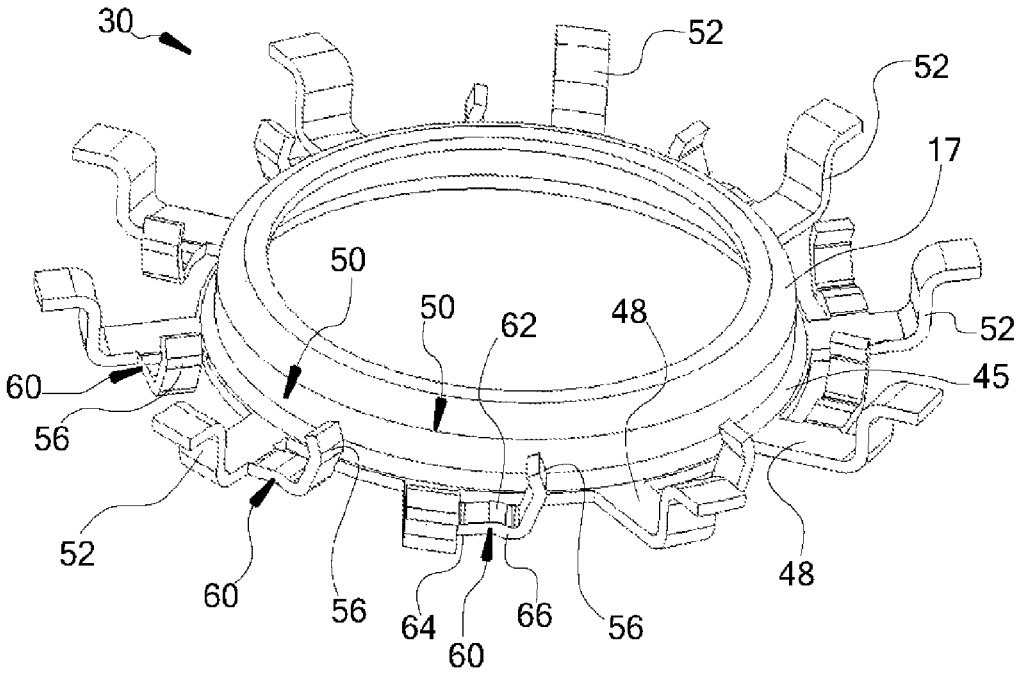
FIG. 8 is a pictorial view of a portion of the ball cage assembly of FIG. 7.

Sidewall 52 can extend upwardly from a lateral side of the ramp 60, e.g., on the side that is distal base flange 45. The sidewall 52 can be a generally planar tab that stands upright and is preferably configured to at least partially locate or position body cap 20 and/or an inner or outer ring 17 and 18 with respect to the remainder of valve rotator 5. In some implementations, sidewalls 52 include an outwardly extending portion that projects perpendicularly from its top edge, parallel to the bottom wall 12 (FIGS. 7 and 8).

Referring now to FIGS. 4 and 5, in typical implementations, forward-most portions of the ball cages 50 are defined by a front wall 56. However, a single front wall 56 can define both a forward-most portion of a first ball cage 50 and a rearward-most portion of a second adjacent ball cage 50, whereby the front walls 56 define structures that separate adjacent ball cages 50. Accordingly, a forward facing surface of the front wall 56 can serve as an anchoring point or structure for supporting an end of spring 54.

Still referring to FIGS. 4 and 5, spring 54 can extend from the forward facing surface of a first front wall 56 to bearing ball 40, biasing the bearing ball 40 against a rearward facing surface of a second front wall 56. In this regard, the rearward facing surface of front wall 56 serves as a mechanical stop against which spring 54 pushes and holds the bearing ball 40 in a resting, default state. Specifically referring to FIG. 4, front walls 56 can have rearwardly bent upper portion which can facilitate capturing and holding the bearing balls 40 when the bearing balls are nested into the front walls 56 in the resting, default state. Specifically referring to FIG. 5, it is noted that front wall 56 need not be integral with ramp 60, but rather can be integrated into, e.g., bottom wall 12 of the main body segment 10 or other suitable component of the valve rotator 5.

Figure 9:
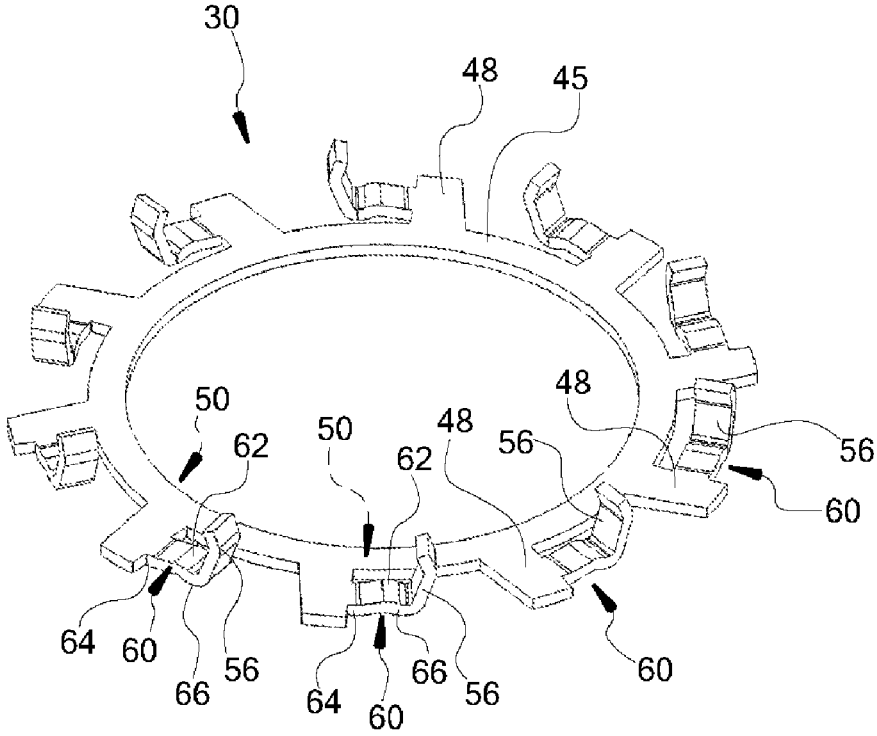
FIG. 9 is a pictorial view of a portion of the ball cage assembly of FIG. 3.

Referring again to FIGS. 6-9, the ramps 60 can extend directly or indirectly from, and preferably tangentially with respect to, an inner or outer perimeter of base flange 45. As an example of the ramps extending indirectly from base flange 45, in some implementations, projections 48 extend between and connect the base flange 45 to the ramps 60 of ball cages 50. FIG. 6 shows projections 48 extending between and connecting an inner perimeter of flange 45 with respective ends of ramp 60. FIGS. 7-9 show projections 48 extending between and connecting an outer perimeter of flange 45 with respective ends of ramp 60.

Referring yet further to FIGS. 6-9, the multiple ramps 60 are configured to cooperate with each other to balance or distribute loads, especially axially directed or axially directed components of loads, which enter the valve rotator 5 between the multiple ramps 60. Doing so mitigates localized applications of forces, or force differentials realized between different portions of the valve rotator 5. This can be accomplished by providing separate and distinct deflectable or bendable characteristics of the separate and distinct multiple ramps 60.

In other words, regardless of their particular orientation with respect to the flange 45, the multiple ramps 60 are configured to be resilient or elastically bend or deflect independently of each other. Doing so enhances equalization and/ or other distribution of forces that are inputted into valve rotator 5, ensuring that all of the multiple bearing balls 40 will at least partially share input forces or loads, regardless of where such input force is applied to the surface(s) of valve rotator 5. In other words, ramps 60 are configured to collectively or otherwise accommodate non-uniform applications of force into the valve rotator 5 by, e.g., equalizing and/or otherwise distributing non-uniform loads through the valve rotator 5 in a relatively more uniform manner than how they are inputted.

Still referring to FIGS. 6-9, each of the ramps 60 is a generally planar member that extends angularly over and is at least partially spaced from the upper surface 14 of bottom wall 12. The ramps 60 can be substantially or entirely planar, optionally, at least somewhat arcuate, or optionally can define an apex 62 between first and second sloping segments 64 and 66 that slope angularly in opposing directions. In this configuration, front and rear portions of the ramps 60 contact and are supported by the bottom wall 12 of main body segment 10, while a central portion that is defined at least partially by apex 62 is vertically spaced therefrom. Regardless of the particular configuration of the ramps 60, preferably, each of them has a lower surface that is spaced from and faces the upper surface 15 of bottom wall 12, and an upper surface that supports, carries, and interfaces with the bearing balls 40 (FIG. 7).

Referring now to FIGS. 1-5 and 7, as mentioned above, the ramps 60 are elastically, resiliently, and/or otherwise restorably deflectable or bendable, separately from each other. This can be accomplished by making the ramps, and preferably the various other structures of the ball cage assembly 30 connected thereto, out of stamped spring steel. Stamped spring steel is exemplary of a suitable material that allows for individual elastic deflection of every ramp 60 in case of excessive loading of a corresponding bearing ball 40, which can prevent or at least mitigate the likelihood of pitting, grooving, and/or other non-desired wear of spring disk 25 that is caused by overloading the interface of the spring disk 25 and bearing ball 40.

Referring again to FIGS. 1-5, it is noted that the particular spring constant or elastic modulus of the ramps 60 is selected so that, e.g., as the multiple ramps 60 deflect during instances of axial compressive loading of the valve rotator 5, the ramps 60 can maintain angles of inclination while deflecting that are sufficiently great to allow the bearing balls 40 to roll down the respective ramps 60 when the main body segment 10 and body cap 20 are squeezed together. Preferably ramps 60 and/or other components of the ball cage assembly 30 are made from spring steel, like spring disk 25, which is heat treated to obtain the desired toughness properties or other characteristics.

In this regard and by way of such configuration(s), the ramps 60 that are located nearer to input forces of relatively greater magnitude will deflect relatively more. Correspondingly, ramps 60 that are located further from input forces (or nearer input forces of lesser magnitude) will deflect relatively less. Since the ramps 60 deflect to varying degrees in a manner that corresponds to variations in input force magnitude, non-uniform forces that are inputted into the ball cage assembly 30 can be spread out or distributed through the ball cage assembly 30, entering the main body segment 10 in a more uniform manner.

In addition to the load-distributing effects of the ramps 60, it is noted that the deflectable characteristics of the ramps can provide a cushioning effect to the inputted forces. This allows for the likelihood of shock-loading type or otherwise harsh engagement of the valve rotator 5. In other words, the cushioning effect that is associated with deflecting the ramps 60 allows the complete assemblage of valve rotator 5 to ease into its turning or rotating engagement of the respective valve.

In light of the above, to use the valve rotator 5, it is first installed onto a valve of an internal combustion engine, as either a supplemental or replacement valvetrain component, either above or below a valve spring based on the intended end use configuration. During operation of the internal combustion engine, as the valve opens and the valve spring is being increasingly compressed, it correspondingly imposes an increasing force on the valve rotator 5. Upon so doing, the spring disk 25 is being increasingly deflected, reducing an effective height of the ball cages 50. This in turn transfers the force into the bearing balls 40, making them roll towards the deeper ends of the ramps 60 within each individual cage 50, thus causing rotation of the main body segment 10 with respect to the body cap 20. If any one(s) of the bearing balls 40 is subjected to a greater force at this time, then the corresponding ramp 60 supporting that bearing ball 40 deflects downwardly further than the others, whereby the remaining bearing balls 40 assume relatively more of the total imputed load which distributes or equalizes such non-uniform force application throughout the ball cage assembly 30 and into the main body segment 10. Then, as the valve closes, the spring disk 25 returns to the previous less deflected state, increasing the heights of the cages 50. This allows the springs 54 to push or bias the bearing balls 40 back up the ramp 60, toward and ultimately against the front wall 56.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is also noted that in general, term used herein correspond to orientations and positions in the FIGS. as illustrated, which may or may not correspond to end use applications. For example, structures described as overlying certain other structures in this description may in fact by underlying the same structures in an end use application, or otherwise.

It is intended that the appended claims cover all such additions, modifications, and rearrangements, whereby various alternatives are contemplated as being within the scope of the following claims particularly pointing out and distinctly claiming the subject matter regarded as the invention.

I claim:

1. A valve rotator comprising:

(a) a main body segment having a bottom wall with an upper surface thereof;

(b) a body cap overlying the main body segment; and (c) a ball cage assembly including multiple ramps having lower surfaces that are spaced from the bottom wall upper surface of the main body segment, allowing the multiple ramps to deflect toward the bottom wall upper surface of the main body segment, wherein the multiple ramps are deflected independently of each other, facilitating establishment of different distances between respective ramps and the bottom wall upper surface of the main body segment for accommodating non-uniform applications of force into the valve rotator.

2. The valve rotator of claim 1 wherein the ramps are deflected independently of each other, such that non-uniform forces that are axially directed into a housing assembly deflect differing ramps to differing extents, respectively, balancing a distribution of the non-uniform forces between multiple bearing balls.

3. The valve rotator of claim 2 wherein the ramps are attached to and extend upwardly from a flange.

4. The valve rotator of claim 3 wherein the ramps are provided outside of an outer perimeter of the flange.

5. The valve rotator of claim 4 wherein projections extend between and connect the ramps to the outer perimeter of the flange.

6. The valve rotator of claim 5, further comprising front walls extending upwardly from the ramps, and wherein a distance between a leading edge of a first projection and a trailing edge of a second adjacent projection corresponds to a summation of, (i) a length of a ramp extending between the first and second projections; and (ii) a height of a front wall extending from the ramp.

7. The valve rotator of claim 5, further comprising side walls extending upwardly from the projections and generally perpendicularly to the ramps.

8. The valve rotator of claim 4 wherein the ramps extend tangentially with respect to an outer perimeter of the flange.

9. The valve rotator of claim 3 wherein the ramps are provided inside of an inner perimeter of the flange.

10. The valve rotator of claim 9 wherein projections extend between and connect the ramps to the inner perimeter of the flange.

11. The valve rotator of claim 10, further comprising front walls extending upwardly from the ramps, and wherein a distance between a leading edge of a first projection and a trailing edge of a second adjacent projection corresponds to a summation of, (i) a length of a ramp extending between the first and second projections; and (ii) a height of a front wall extending from the ramp.

12. The valve rotator of claim 2 wherein the ball cage assembly includes front walls extending upwardly from the ramps.

13. The valve rotator of claim 2, wherein the ramps define an apex and first and second sloping segments that slope in opposing directions.

14. A valve rotator comprising:

(a) a housing assembly having a generally circular perimeter and defining a void space therein; and (b) a ball cage assembly that is separate from the housing assembly and housed within the void space of the housing assembly, and having (i) multiple ramps extending upwardly from a lower portion thereof and tangentially or obliquely with respect to the housing assembly perimeter;

(ii) multiple bearing balls supported by the multiple ramps, wherein the multiple ramps are deflectable during instances of axial compressive loading of the valve rotator, and wherein the ramps maintain angles of inclination while deflecting such that the bearing balls roll down the respective ramps during such instances of axial compressive loading of the valve rotator.

15. The valve rotator of claim 14 wherein the ramps are deflected independently of each other, such that non-uniform forces that are axially directed into the housing assembly deflect differing ramps to differing extents, respectively, balancing a distribution of the non-uniform forces between the multiple bearing balls.

16. The valve rotator of claim 15 wherein each of the ramps includes a first portion extending upwardly in a first direction and a second portion extending downward in a second direction.

17. The valve rotator of claim 16 wherein the housing assembly includes a main body segment and a body cap.

18. The valve rotator of claim 17, further comprising an annular disk extending between the main body segment and the body cap.

19. The valve rotator of claim 18 wherein the annular disk defines an inner perimeter and an outer perimeter, (i) the disk inner perimeter being supported by the main body segment; and (ii) the disk outer perimeter being supported by the body cap.

20. A valve rotator comprising:

(a) a main body segment having a generally circular perimeter and accepting a valve component therethrough;

(b) a body cap overlying the main body segment, the main body segment and the body cap being axially and rotationally movable with respect to each other; and (c) a ball cage assembly that is separate from and housed between the main body segment and the body cap, and having (i) multiple ramps that are deflectable toward the main body segment;

(ii) multiple bearing balls supported by the multiple ramps, wherein reducing an axial distance between the body cap and main body segment increases a pinch force between the bearing balls and the body cap and correspondingly forces the bearing balls to roll down the ramps, such that in an event of non-uniform axial force application to the valve rotator, at least one of the ramps is deflected relatively further than the others and correspondingly balances a distribution of the non-uniform axial force application between the multiple bearing balls.

* * * * *